US005123437A

United States Patent [19]

Egli et al.

[11] Patent Number: 5,123,437

[45] Date of Patent: Jun. 23, 1992

[54] SAFETY VALVE ARRANGEMENT FOR A SINGLE LEVER WATER TAP

[75] Inventors: Werner Egli, Eglisau; Jakob Wettstein, Fehraltorf, both of Switzerland

[73] Assignee: Armaturenfabrik Wallisellen AG, Wallisellen, Switzerland

[21] Appl. No.: 686,968

[22] Filed: Apr. 18, 1991

[30] Foreign Application Priority Data

Apr. 20, 1990 [CH] Switzerland ..... 1343/90

[51] Int. Cl.[5] ..... E03C 1/10

[52] U.S. Cl. ..... 137/218; 4/678

[58] Field of Search ..... 4/191, 192; 137/218

[56] References Cited

U.S. PATENT DOCUMENTS

| | | | |
|---|---|---|---|
| 2,472,933 | 6/1949 | Anderson | 137/218 |
| 3,076,470 | 2/1963 | Langdon | 137/218 |
| 3,286,722 | 11/1966 | Royer | 137/218 |
| 4,696,322 | 9/1987 | Knapp et al. | 137/218 |
| 4,827,538 | 5/1989 | Heimann et al. | 137/218 X |
| 4,977,920 | 12/1990 | Oberdorfer | 137/218 |
| 5,009,247 | 4/1991 | Oberdorfer | 137/218 |
| 5,038,814 | 8/1991 | Gayton et al. | 137/218 |

FOREIGN PATENT DOCUMENTS

| | | | |
|---|---|---|---|
| 2020610 | 12/1971 | Fed. Rep. of Germany | 137/218 |
| 3805462 | 8/1989 | Fed. Rep. of Germany | 137/217 |

*Primary Examiner*—Gerald A. Michalsky

*Attorney, Agent, or Firm*—Sughrue, Mion, Zinn, Macpeak and Seas

[57] ABSTRACT

A safety valve arrangement for a single lever water tap includes, disposed coaxially in series in a removable module 18, a first air ventilating valve 20, a second air ventilating valve 21, and a non-return valve 22 coupled to and controlling the second ventilating valve. The non-return valve is disposed in the mixed water outlet passage of the tap such that when it opens in response to a water demand, it automatically closes the second ventilating valve, and vice versa.

8 Claims, 2 Drawing Sheets

SAFETY VALVE ARRANGEMENT FOR A SINGLE LEVER WATER TAP

BACKGROUND OF THE INVENTION

A return flow prevention arrangement in a draw-off tap with an extensible outlet nozzle for a sink basin is known from U.S. Pat. No. 4,696,322. This draw-off tap includes a mixing valve with a hollow sphere-shaped valve body in the tap housing. The housing has two supply connections and one mixed water outlet channel. A diaphragm-like ventilating valve, which opens into the mixed water channel within the mixing valve body, is built into the valve body of the mixing valve. The air supply openings to the ventilating valve are arranged on the upper side of the mixing valve body. If one of the supply lines has reduced pressure, air is sucked in through the ventilating valve and thus water is prevented from being sucked in from the outlet nozzle. This is advantageous because the extensible nozzle can lie, under some circumstances, in the sink basin filled with dirty water.

The drawbacks with this known return flow safety valve arrangement are that the return flow of the water into the supply lines cannot be reliably prevented by the ventilating valve alone, and the ventilating valve is not accessible for maintenance. When it is defective, the entire mixing valve body must be replaced, which is quite expensive. In addition, it is almost impossible to check the functionality of the ventilating valve.

SUMMARY OF THE INVENTION

An object of the present invention is thus to provide a return flow prevention arrangement of the aforementioned kind that is reliable and can be repaired in a cost-effective manner. This object is achieved by providing a safety valve arrangement for a single lever water tap which includes, disposed coaxially in series in a removable module, a first air ventilating valve, a second air ventilating valve, and a non-return valve coupled to and controlling the second ventilating valve. The non-return valve is disposed in the mixed water outlet passage of the tap such that when it opens in response to a water demand, it automatically closes the second ventilating valve, and vice versa.

DETAILED DESCRIPTION OF THE PREFERRED EMBODIMENT

Figure 1:
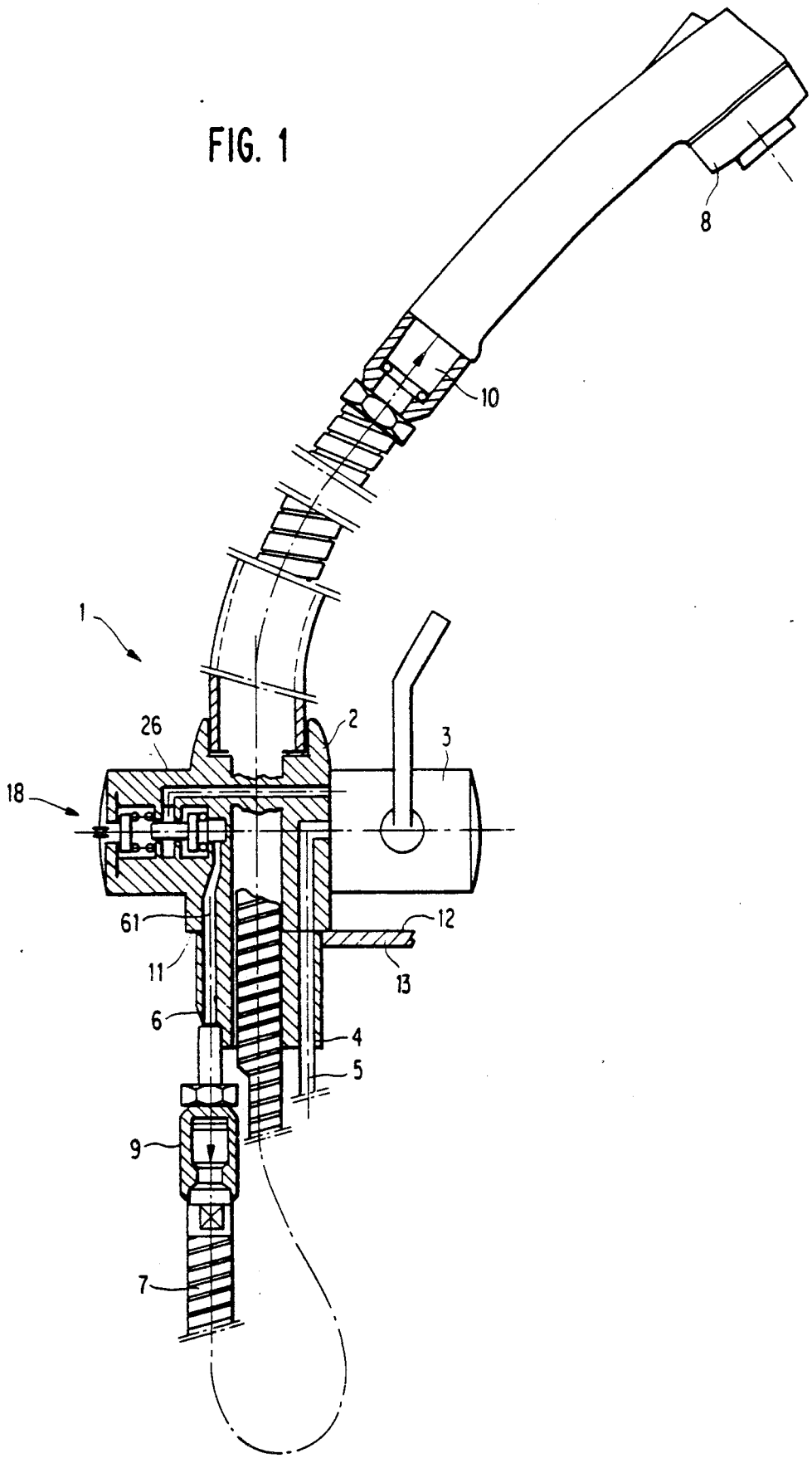
FIG. 1 is a sectional view of a draw-off tap in accordance with the invention.

The tap 1 shown in FIG. 1 includes a tap housing 2 with a mixing valve 3, two supply connections 4 (of which only one is visible, to which supply lines 5 for hot and cold water are attached, and a mixed water connection 6, to which an extensible outlet nozzle 8 in the form of a hand spray is attached. Downstream of the connection 6, two non-return valves 9, 10 are installed in the mixed water line 7 leading to the outlet nozzle. Housing 2 has a contact face 11 with which it abuts against an upper surface 12 of a sink basin 13, which is only partially shown. Surface 12 defines the highest level that the water standing in the sink basin can reach.

Figure 2:
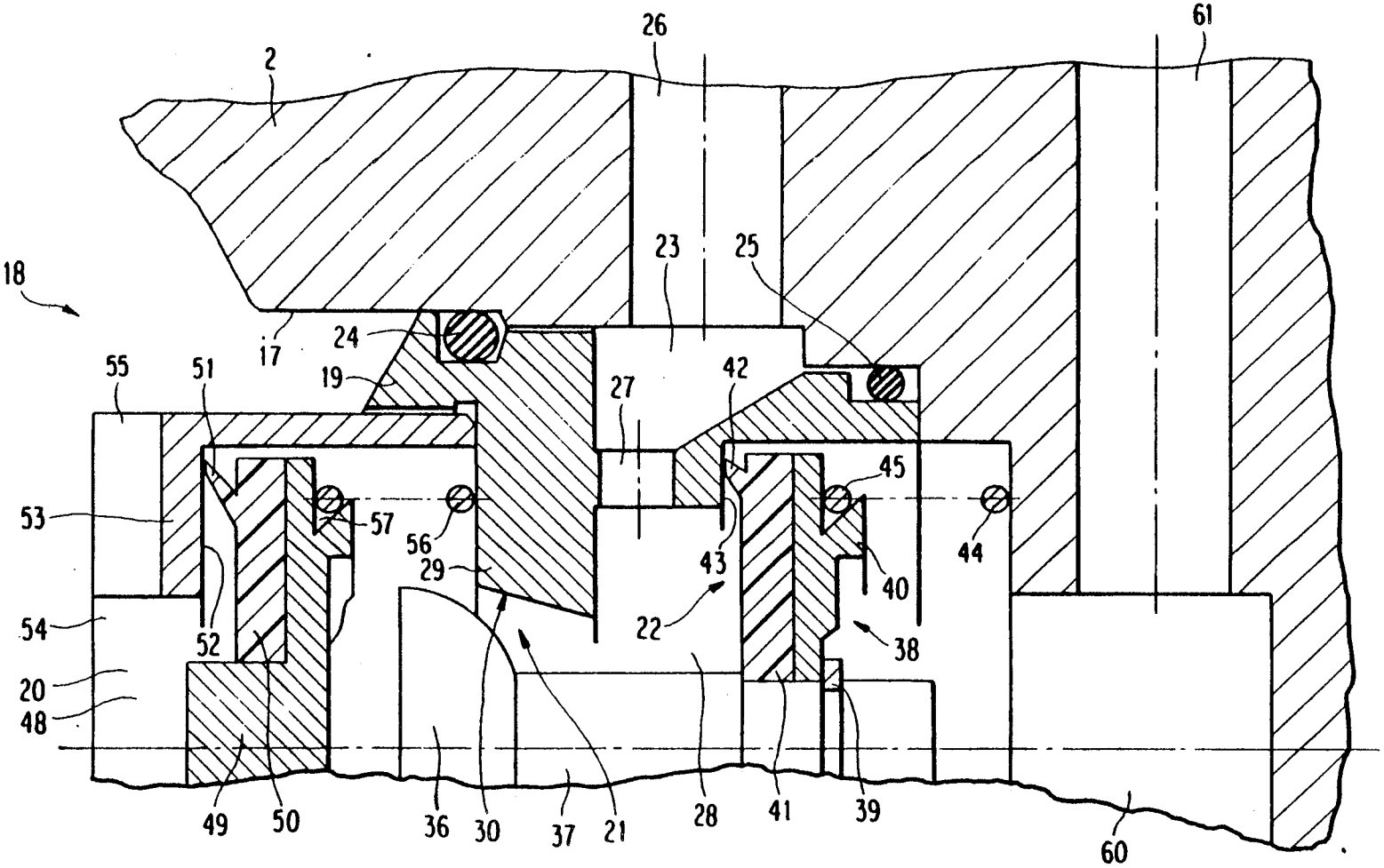
FIG. 2 is a partial cross sectional view of the tap housing.

A module 18 comprising a two-piece, screwed together sleeve 19, two ventilating valves 20, 21, and a non-return valve 22 are screwed into a stepped bore 17 (FIG. 2) of the housing 2. The sleeve 19 has on its circumference an annular groove 23, which is sealed by two o-rings 24, 25. The mixed water channel 26 coming from the mixing valve 3 empties radially into the annular groove 23. Several radial bores 27 lead from the bottom of the groove into a chamber 28, which is closed against the outside by a separating wall 29 of sleeve 19 with an axial, conical bore 30. Bore 30 forms the valve seat for the fructo-spherical, plastic valve body 36 of valve 21. Valve body 36 is rigidly connected by a shaft 37 to the coaxial valve body 38 of non-return valve 22. Valve body 38 is slid over shaft 37 with an axial bore and secured with a snap ring 39. Valve body 38 comprises a rigid disk 40 and an elastomer disk 41 having a peripheral sealing lip 42, which abuts against a radial shoulder 43 of sleeve 19. The diameter of the sealing lip 42 is significantly greater than the diameter of the valve body 36 at the point where the valve body abuts against bore 30 when valve 21 is closed. In the pressureless state valve body 3 is forced into the closed position of the non-return valve 22 by a spring 44. Spring 44 is locked into a groove 45 of disk 40 so that it forms part of the replaceable module 18.

The first ventilating valve 20 is also a seat valve. Its valve body 48 again comprises a rigid disk 49 and an elastomer disk 50 having a peripheral sealing lip 51, which abuts against the inside 52 of face wall 53 of sleeve 19. An axial bore 54 is drilled through face wall 53 as the air supply opening, and a screw driver slot 55 for assembly and disassembly is cut into the face wall. Valve body 48 is also preloaded by a spring 56 into the closed position. Spring 56 is also locked into a groove 57 of disk 49. The spring 56 is selected such that valve 20 opens at very low pressure.

In service, when the mixing valve 3 is closed, the three non-return valves 9, 10, 22 and valve 20 are closed. If the mixing valve 3 is opened, water flows out of one or both supply lines 5 through channel 26 and into chamber 28, and builds up a pressure that opens the non-return valve 22 and thus automatically closes the ventilating valve 21. The water flows through the non-return valve 22 into an axial chamber 60 of bore 17, and from there through a radial bore 61 to connection 6. Due to the diameter differential between valve bodies 36, 38, the greater the pressure drop across and the flow through the non-return valve 22, the greater the closing force of valve 21. If the mixing valve 3 is closed again, the non-return valve 22 closes with the falling water pressure due to the spring 44, and the ventilating valve 21 is automatically opened. Owing to the closing and opening stroke of the valve 21 following each usage of the mixing valve 3, the valve 21 cannot calcify or Otherwise be blocked by non-usage. The primary function of valve 21 is to prevent a short-term opening of the ventilating valve 20 when the mixing valve 3 is closed quite rapidly following a high flow of water, thus preventing the water from escaping through bore 54. If the flow of water is reduced very rapidly, a reduced pressure can form in chamber 60 due to the inertia of the water column still flowing in hose 7 and also in chamber 28 due to the still open non-return valve 22. However, since this reduced pressure stresses the still closed valve 21 in a closing sense, it cannot effect valve 20. Thus, with the second ventilating valve 21 coupled directly to the non-return valve 22, the ventilating valve 20 remains closed even when mixing valve 3 is closed quite rapidly; thus, no water can escape through the air supply opening 54.

If the pressure should fall in one of the two supply lines 5, e.g. due to a pipe line rupture when mixing valve 3 is open, the flow is stopped by the non-return valve 22 and it closes due to the force of spring 44. Thus, ventilating valve 21 is automatically opened and the reduced pressure in channel 26 acts on valve body 48 of ventilating valve 20, which opens against the force of spring 56 and allows air to flow via opening 54, channel 26 and mixing valve 3 into the supply line(s) 5. Valve body 38 of non-return valve 22 is also loaded in a closing sense by the reduced pressure so that no water can be siphoned in through outlet nozzle 8, which could, for example, lie in the sink basin which could be filled at least in part with dirty water. Thus, dirty water is effectively prevented from being sucked into the supply pipe network. In addition, due to the supply of air into the pipe network, dirt is prevented from being sucked into the network due to other taps that are less well protected or by leaks in the pipe network.

Since the ventilating valves 20, 21 and the non-return valve 22 are mounted in a readily replaceable module 18, these parts can be easily maintenance checked and, when necessary, be replaced at a low cost.

The radial bores 26 and 61 communicating with groove 23 and chamber 60 can be angled and distributed arbitrarily around the periphery of the housing 2 so that the installation position of the module 18 can be selected arbitrarily. Preferably its arrangement is constructed in such a manner that module 18 can be installed and removed without any problems when tap 1 is assembled. To this end it is preferred that bore 17 in tap housing 2 be attached on the side and above the contact face 11.

We claim:

1. A safety valve arrangement for a water tap (1) adapted to be mounted to a sink basin (13) and including a mixing valve (3) disposed in a tap housing (2), two water supply connections (4) on the housing, and a mixed water channel (26, 61) connecting an outlet of the mixing valve to an extensible outlet nozzle (8), said safety valve arrangement comprising:

a first air ventilating vale (20) mounted in the tap housing, biased toward a closed position, and communicable, when in an open position, with the mixed water channel; a non-return valve (22) mounted in the tap housing, in the mixed water channel, biased toward a closed position, and disposed downstream in a direction of normal water flow, of a point (28) whereat the first ventilating valve is communicable with the mixed water channel; and a second ventilating vale (21) independent of the first ventilating vale and controlled to automatically close when the non-return valve (22) opens, said second ventilating valve being disposed in series with the first ventilating valve (20), wherein the second ventilating valve (21) and the non-return valve (22) are designed as seat valves, wherein a valve body (36) of the second ventilating valve is rigidly connected to a valve body (38) of the non-return valve, and wherein an effective area of the valve body of the nonreturn valve is greater than an effective area of the valve body of the second ventilating valve.

2. An arrangement as claimed in claim 1, wherein the valve body (38) of the non-return valve (22) is biased in a closing direction by a spring (44).

3. An arrangement as claimed in claim 2, wherein the first ventilating valve (20) is a spring-loaded seat valve.

4. An arrangement as claimed in claim 1, wherein the first ventilating valve (20) and the non-return valve (22) are coaxially mounted in a sleeve (19) detachably installed in the tap housing (2) and form therewith a replaceable module (18).

5. An arrangement as claimed in claim 1, wherein an air supply opening (54) to the first ventilating valve (20) is mounted above a contact face (11) of the tap housing (2) by at least half the outer diameter of the valve body (38) of the non-return valve (22), said contact face defining a maximum retaining height of the sink basin (13).

6. An arrangement as claimed in claim 1, wherein downstream of the first non-return valve (22) at least one other non-return valve (9, 10) is installed, and wherein upstream of the point (28) whereat the first ventilating valve (20) is communicable with the mixed water channel, no other non-return valves are installed such that with reduced pressure in a water supply connection and an open mixing valve (3), said water supply connection is ventilated and the mixed water supply to the outlet (8) remains closed.

7. An arrangement as claimed in claim 4, wherein the module (18) is mounted on a side of the tap housing so as to be easily removable therefrom with the water tap (1) standing under pressure.

8. An arrangement as claimed in claims 4 or 5, wherein an annular chamber (23) into which the mixed water channel (26) from the mixing valve (3) empties is defined on a periphery of the module (18) by two spaced sealing rings (24, 25).

* * * * *